US012127643B1

(12) United States Patent
Lallo et al.

(10) Patent No.: US 12,127,643 B1
(45) Date of Patent: Oct. 29, 2024

(54) STRAP AND A WEARABLE DEVICE COMPRISING A STRAP

(71) Applicant: Suunto Oy, Vantaa (FI)

(72) Inventors: Jere Lallo, Vantaa (FI); Mikko Ahlström, Vantaa (FI); Atte Kuparinen, Vantaa (FI); Mu He, Vantaa (FI); Miika Keskinen, Vantaa (FI); Jukka Rautiainen, Vantaa (FI); Pinja Rouger, Vantaa (FI)

(73) Assignee: Suunto Oy, Vantaa (FI)

( * ) Notice: Subject to any disclaimer, the term of this patent is extended or adjusted under 35 U.S.C. 154(b) by 0 days.

(21) Appl. No.: 18/657,827

(22) Filed: May 8, 2024

(30) Foreign Application Priority Data

May 8, 2023 (FI) ..... 20235509

(51) Int. Cl.
*A44C 5/20* (2006.01)

(52) U.S. Cl.
CPC ..... *A44C 5/2023* (2013.01); *A44C 5/2042* (2013.01)

(58) Field of Classification Search
CPC ..... A44C 5/2023; A44C 5/2042; A44C 5/22; G04B 37/1446; G04B 37/1486; G04B 37/1493; Y10T 24/4782
USPC ..... 224/164, 172; 368/282
See application file for complete search history.

(56) References Cited

U.S. PATENT DOCUMENTS

| | | | | | |
|---|---|---|---|---|---|
| 1,216,322 | A * | 2/1917 | Kales | A44C 5/14 | 224/164 |
| 1,222,391 | A * | 4/1917 | Grant | G04B 37/1486 | 368/282 |
| 1,444,574 | A * | 2/1923 | Walter | A44C 5/22 | 24/635 |
| 4,855,974 | A * | 8/1989 | Steinmann | A44B 11/18 | 224/175 |
| 5,117,406 | A * | 5/1992 | Sullivan | G04B 37/1486 | 368/282 |
| 5,425,007 | A * | 6/1995 | Walter | A44C 5/22 | 368/282 |
| 6,073,821 | A * | 6/2000 | Mercer | A44C 5/22 | 368/282 |
| 2020/0029661 | A1* | 1/2020 | Tobiassen | A44C 5/22 | |
| 2022/0087373 | A1* | 3/2022 | Kozak | A44C 5/2042 | |
| 2024/0008601 | A1* | 1/2024 | Chang | A44C 5/2042 | |
| 2024/0008602 | A1* | 1/2024 | Chang | A44C 5/14 | |

FOREIGN PATENT DOCUMENTS

| | | | |
|---|---|---|---|
| CN | 112137254 | A | 12/2020 |
| EP | 1454551 | A1 | 9/2004 |

* cited by examiner

*Primary Examiner* — Jack W Lavinder
(74) *Attorney, Agent, or Firm* — Laine IP Oy

(57) ABSTRACT

According to an example aspect of the present invention, there is provided a strap for a wearable device having a terminal device. A fixed buckle is provided to one end of the body of the strap to receive the strap body through the fixed buckle in a looped configuration of the strap. A slide buckle is provided movably to the strap body and has an open keeper hook for removably receiving an excess portion of the strap body through the keeper hook. The strap has a first keeper counterpart provided on the strap body, and a second keeper counterpart provided to a second end of the strap body for attachment to the first keeper counterpart.

16 Claims, 10 Drawing Sheets

STRAP AND A WEARABLE DEVICE COMPRISING A STRAP

FIELD

The present disclosure relates to apparatuses for affixing a wearable electronic device to the user's anatomy. In particular, the disclosure relates to straps with a wide range of adjustability.

BACKGROUND

There is an abundance of different straps and bands for wearable devices, such as watches, sporting instruments, sensors, etc. Comfortable fit and range of adjustability is an important goal in designing straps for outdoor wearable equipment, such as sports and fitness watches. Diving watches, in particular, are a challenging category of wearable devices because the strap should ideally provide for a wide range of adjustability to provide wearing the watch directly against the skin but also on top of a thick layer of diving suit. The same holds true for wearable devices intended to be worn both directly on the wrist and alternatively on top a thick skiing jacket.

Whenever a strap is designed to provide for a wide range of adjustability, there is typically a trade-off in usability because the excess strap portion cannot be left loose and must be somehow tacked to the tightened portion of the strap. Conventional solutions for managing loose strap portions include retainer loops around the strap body as well as using hook-and-loop strap material (also known as Velcro®) which attaches to itself. These solutions are, however, poorly suited for demanding use cases. In diving, for example, retainer loops require dexterity and create an extra entanglement point whereas a hook-and-loop strap will come undone under water.

There therefore remains a need for a strap that provides for a wide range of adjustability and also reliable management of the loose strap portion.

SUMMARY

The invention is defined by the features of the independent claims. Some specific embodiments are defined in the dependent claims.

According to a first aspect of the present disclosure, there is provided a strap for a wearable device comprising a terminal device. The strap features a strap body and a fixed buckle provided to one end of the strap body. The fixed buckle is set to receive the strap body there through in a looped configuration of the strap. A slide buckle is provided movably to the strap body and has an open keeper hook for removably receiving an excess portion of the strap body through the keeper hook. The strap also features a first keeper counterpart, which is provided on the strap body, and a second keeper counterpart, which is provided to a second end of the strap body for attachment to the first keeper counterpart.

According to a second aspect of the present disclosure, there is provided a wearable device, which includes a terminal device as well as a strap according to the first aspect attached to the terminal device.

According to a further aspect of the present disclosure, there is provided a strap for a wearable device comprising a terminal device. The strap comprises a first strap piece. The first strap piece comprises a strap body, which extends between a first end for attachment to the terminal device and a second end. The first strap piece also comprises a first keeper counterpart. The strap also comprises a second strap piece. The second strap piece comprises a strap body, which extends between a first end for attachment to the terminal device and a second end. The strap also comprises a fixed buckle provided at the second end of the first strap piece and configured to receive the strap body of the second strap piece through the fixed buckle. The strap also comprises a slide buckle provided movably to the second strap piece and comprising an open keeper hook for removably receiving an excess portion of the second strap piece through the keeper hook. The strap also comprises a second keeper counterpart, such as an end hook, provided to the second end of the second strap piece for repetitive removable attachment to the first keeper counterpart.

Certain embodiments may include one or more features from the following itemized list:

- the strap body is made of a pliable material;
- the first keeper counterpart is fixed to the strap body;
- the first keeper counterpart is provided to the external side of the strap facing away from the user;
- the first keeper counterpart is configured to receive the second keeper counterpart transversally in respect to a main extending dimension of the strap;
- the first keeper counterpart is a keeper loop;
- the keeper loop is formed by sewing from the material of the strap body;
- the fixed buckle is a friction buckle;
- the fixed buckle is a cam buckle;
- the fixed buckle is configured to selectively lock the strap body, which extends through the fixed buckle;
- the slide buckle is set to receive the strap body through an opening in the body of the slide buckle;
- the slide buckle is set to slide along the strap body;
- the slide buckle comprises an open keeper hook;
- the keeper hook is set to removably receive and hold an excess portion of the strap body;
- the keeper hook is provided to the external side of the strap;
- the strap has a first strap piece and a second strap piece;
- the strap body is split between respective bodies of the strap pieces;
- the strap body of the first strap piece extends between a first end and a second end;
- the first end of the first strap piece is for attachment to the terminal device;
- the fixed buckle is provided to the second end of the first strap piece;
- the strap body of the second strap piece extends between a first end and a second end;
- the first end of the second strap piece is for attachment to the terminal device;
- the second keeper counterpart is provided to the second end of the second strap piece;
- the respective first ends of the strap parts comprise affixers for fixing the strap to the wearable device;
- the slide buckle provided movably to the second strap piece,
- the first keeper counterpart is fixed to the first strap piece.

Considerable benefits may be gained with aid of the present concept. By being able to control the excess portion of the strap "outside" the fixed buckle, the strap may be devised as relatively long thus providing for great adjustment range, which is beneficial in many applications, such as in diving instruments. The mechanical engagement between the keeper counterparts provide for a reliable attachment, which will not come undone even in water.

Additionally, the slide buckle enables the excess strap portion to be pressed taut against the rest of the strap, which minimizes the risk of the strap entangling with an external object, such as a branch. The slide buckle also provides for a third layer of strap material that may cover some of the hardware on the strap thus smoothening out the façade of the strap. The simple but effective strap concept is applicable to a variety of different strap materials and hardware options to cater for different user preferences and use cases.

BRIEF DESCRIPTION OF THE DRAWINGS

In the following certain exemplary embodiments are described in greater detail with reference to the accompanying drawings, in which.

EMBODIMENTS

The embodiment shown in FIGS. 1 to 10 is designed to provide a means for wearing a terminal device, such as a dive watch, on a user with improved adjustability and convenience. In the present context the word "strap" is interchangeable with "band" and "bracelet".

Figure 1:
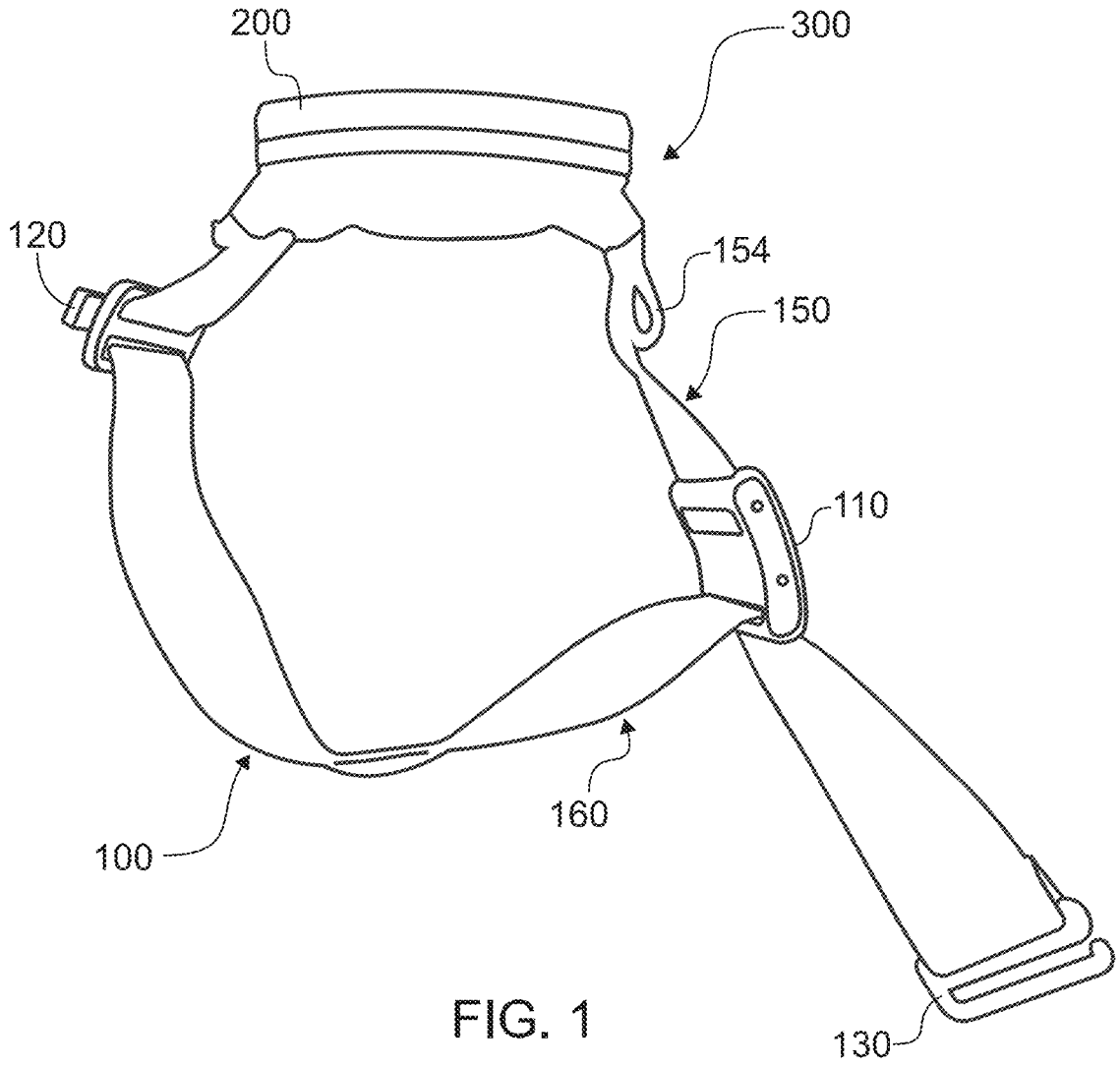
FIG. 1 illustrates a perspective view of a wearable device having a strap in accordance with at least some embodiments of the present invention attached to a watch case and in a loosened configuration.

FIG. 1 illustrates a strap 100 in accordance with at least some embodiments attached to a smart watch as an example of a terminal device 200. The smart watch may especially be a smart watch intended for diving, wherein the adjustability of the strap is of great importance. The strap 100 and the terminal device 200 form a wearable device 300. The strap 100 has a first strap piece 150, a second strap piece 160, and hardware associated to the strap pieces 150, 160 for fitting and adjusting the strap 100 around the user's extremity. In the illustrated example the first strap piece 150 is a "short piece", which includes a buckle, and the second strap part 160 is a "long piece", which interacts with the buckle. As is custom in watch straps, such pieces interact with one another for adjusting the circumference of the strap to the user's anatomy. The first and second strap pieces 150, 160 attach to opposite sides of the terminal device 200 and, when connected to each other, form an adjustable loop around the user's wrist, for example.

Figure 2A:
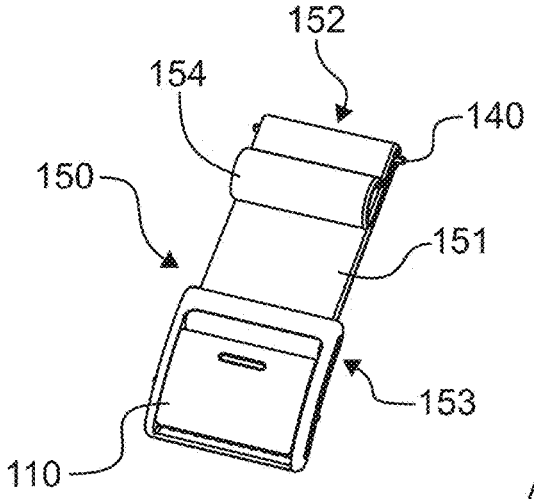
FIG. 2A illustrates a perspective view of the short piece of the strap of FIG. 1.
Figure 2B:
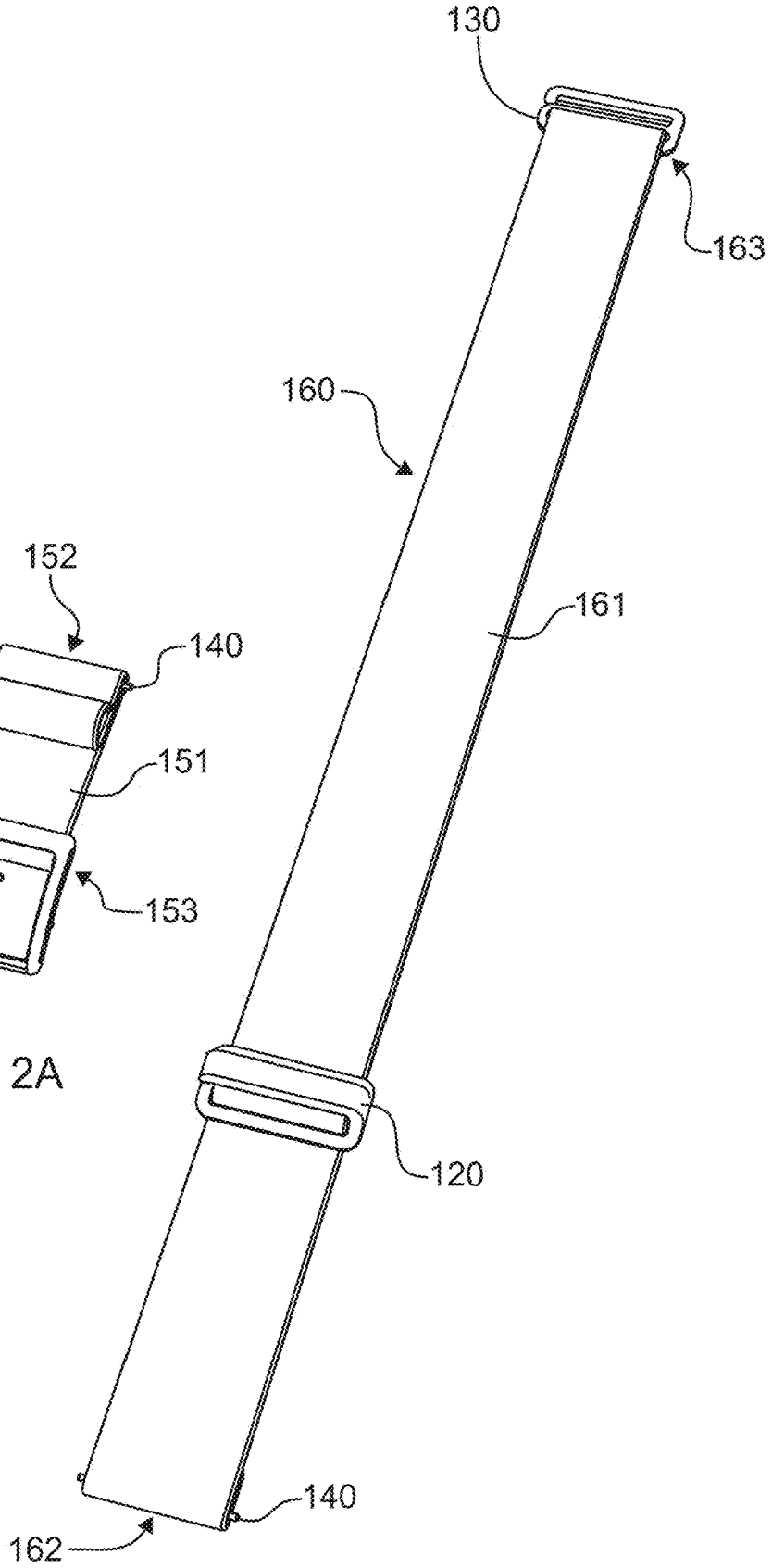
FIG. 2B illustrates a perspective view of the long piece of the strap of FIG. 1.

FIGS. 2A and 2B show the strap pieces in a flat and detached configuration. Let us first examine the first strap piece 150 shown in FIG. 2A. The first strap piece 150 has a strap body 151, which is elongated in a main extending dimension between a first end 152 and a second end 153. The strap body 151 is a pliable strip of material, such as fabric. Suitable materials for the strap body 151 include, but are note limited to, fabrics made of natural or synthetic materials or a mix of natural or synthetic materials, silicone, polyurethane, polyurethane rubber, nylon, microfiber, polyester, fluoroelastomer, particularly FKM, leather, cotton, and linen. It is preferable that the material is flexible enough to be folded with a small radius but also durable enough to endure harsh conditions experienced in sporting use applications, such as diving.

Figure 4:
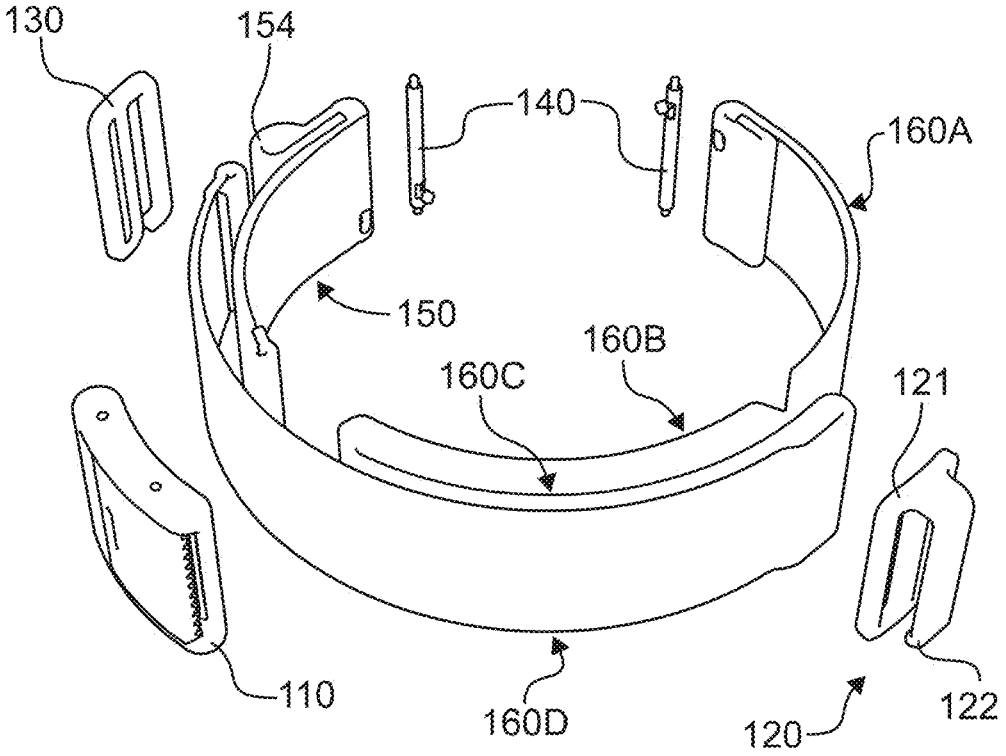
FIG. 4 illustrates a perspective explosion view of the strap of FIG. 1 in a looped and tightened configuration.

The first end 152 of the strap body 151 is intended to attach to the terminal device 200. According to the illustrated embodiment a spring bar 140 is provided to the first end 152 inside a transversal loop formed by folding and sewing the base material of the strap body 151. FIG. 4 reveals how the material of the strap body 151 may be folded to accept the spring bar 140 and pierced for accessing the actuating lever of the spring bar. Such affixer loops are known per se.

The second end 152 of the strap body 151 is intended to interact with the second strap piece 160. Accordingly, a buckle 110 is fixed to the second end 152 of the strap body 151. According to the illustrated embodiment, the fixed buckle 110 is a friction buckle, such as a cam buckle. As is custom, the fixed buckle 110 has an opening for receiving the second strap piece 160 there through. With aid of the cam mechanism the fixed buckle 110 is able to releasably secure to the second strap piece 160 for locking the strap pieces together and, ultimately, fixing the size of the loop of the strap 100. The buckle 110 may be fixed to the strap body 151 with conventional means, such as a pin going through a loop formed at the second end 153.

A first keeper counterpart 154 is also formed to the first strap piece 150. In the illustrated embodiment the first keeper counterpart 154 is constructed as a female counterpart, more specifically as a loop. The purpose of the first keeper counterpart 154 is to engage with and hold on to the end of the excess part of the second strap piece 160. It is preferable to position the first keeper counterpart 154 relatively near the terminal device 200. In the illustrated example, the first keeper counterpart 154 is provided at the first end 152 of the first strap piece 150 such to be near the fixing point, i.e. near the spring bar 140. To accept the free end of the second strap piece 160, the first keeper counterpart 154 forms a laterally accessible space for a cooperating second keeper counterpart 130 of the second strap piece 160. The first keeper counterpart 154 is preferably provided to the external side of the strap 100, i.e. the side facing away from the user. The first keeper counterpart 154 may be formed by folding and sewing the base material of the strap body 151 or by folding and sewing additional material to the strap body 151.

Let us then examine the second strap piece 160, which is shown in FIG. 2B. Similarly to the first strap piece 150, the second strap piece 160 has a strap body 161, which is elongated in a main extending dimension between a first end 162 and a second end 163. The strap body 161 may be made from the same or different pliable strip of material as the strap body 151 of the first strap piece 150.

The first end 162 of the strap body 161 is intended to attach to the terminal device 200. According to the illustrated embodiment a spring bar 140 is provided to the first end 162 inside a transversal loop formed by folding and sewing the base material of the strap body 161. FIG. 4 reveals how the material of the strap body 161 may be folded to accept the spring bar 140 and pierced for accessing the actuating lever of the spring bar.

The second end 163 is the free end of the second strap piece 160, which is intended to interact with the first keeper counterpart 154 of the first strap piece 150. The second end 163 has been provided with a second keeper counterpart 130 such devised to cooperate with the first keeper counterpart 154 to secure the strap 100 into a closed loop configuration. In the illustrated embodiment the second keeper counterpart 130 is constructed as a male counterpart, more specifically as an end hook. The second keeper counterpart 130 is suitable for being inserted into and pulled out of the first keeper counterpart 154. As is best shown in FIG. 4, the second keeper counterpart 130 may take the form a so-called "G-hook" or "9-hook" named after its shape. The exemplary shape includes a loop portion for attaching to the second end 163 of the strap body 161, which is wrapped around the loop portion, and a laterally extending claw portion to be inserted into the first keeper counterpart 154. The space between the loop portion and claw portion of the second keeper counterpart 130 is designed to accept the material of the first keeper counterpart 154 through the open lateral end.

The second strap piece 160 also features a slide buckle 120, which may be moved along the main extending dimension along the strap body 161 between the first end 162 and the second end 163. The purpose of the slide buckle 120 is to set a baseline loop size for the strap 100. The slide buckle 120 is shaped to provide two functions. Firstly, the slide buckle 120 is designed to slide along the strap body 161. As is best illustrated in FIG. 4, the sliding may be achieved by forming the body 121 of the slide buckle 120 to accept the strap body 161 through two successive loops resembling the FIG. 8. Alternatively, the body of the slide buckle may feature a profile (not shown), which envelops the strap body 161 such to allow respective translation. Secondly, the slide buckle 120 is designed to act as a folding keeper for the excess part of the second strap piece 160. To facilitate said secondary function the slide buckle 120 has a keeper hook 122 above the body 121. The keeper hook 122 is elevated from the body 121 so that the excess part of the second strap piece 160 may travel between the body 121 and the keeper hook 122. The keeper hook 122 also provides a turning point, at which the strap body 161 may fold to extend on top of the keeper hook 122 towards the first keeper counterpart 154 at the first end 152 of the first strap piece 150. According to the illustrated example, the lateral side of the keeper hook 122 is open to enable insertion and removal of the strap body 161 to and from the slide buckle 120. Alternatively, the top side of the keeper hook 122 could feature a slit.

Figure 3:
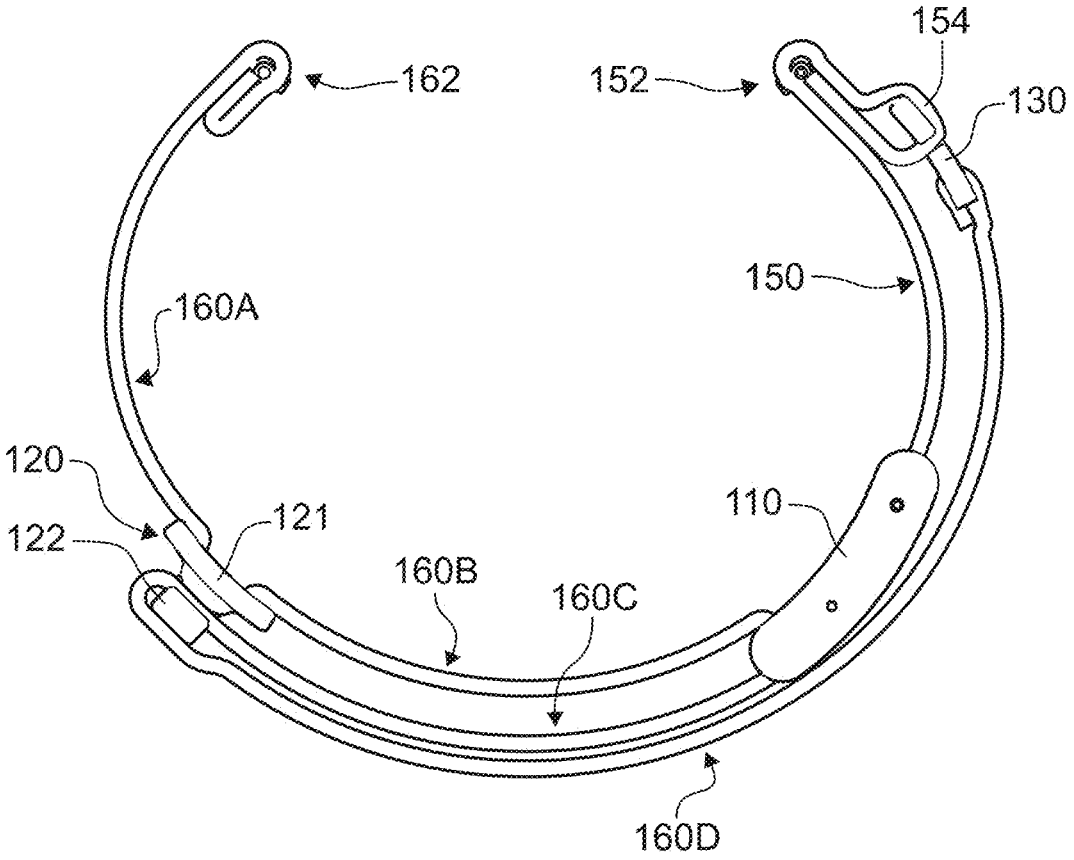
FIG. 3 illustrates a side elevation view of the strap of FIG. 1 in a looped and tightened configuration.

FIG. 3 shows the strap 100 in fully fitted state, in which the strap pieces 150, 160 interact to form a loop around the user's extremity. Let us observe the interaction between the strap pieces 150, 160 starting from the first end 162 of the second strap piece 160 and by dividing the second strap piece into four functional sections 160A . . . 160D formed through the respective placement of the hardware of the strap 100. A first strap section 160A is formed between the first end 162 and the slide buckle 120. FIG. 3 shows the strap body weaving through the body 121 of the slide buckle 120. A second strap section 160B is formed between the slide buckle 120 on the second strap piece 160 and the fixed buckle 110 on the first strap piece 150. It may be observed that the first and second sections 160A, 160B of the strap body of the second strap piece 160 and the strap body of the first strap piece 150 form the inside layer of the strap 100 that is in contact with the user.

As the strap body of the second strap piece 160 extends through the fixed buckle 110, it makes a 180 degree turn to form a second layer, which is a third strap section 160C. The third strap section 160C connects the fixed buckle 110 to the slide buckle 120 on top of the inside layer as an intermediate layer. The strap body of the second strap piece 160 extends through between the keeper hook 122 and the body 121 of the slide buckle 120. Here, the strap body is again folded 180 degrees onto the intermediate layer as an outside layer. From the slide buckle 120 the second strap piece 160 extends towards the first keeper counterpart 154 at the first end 152 of the first strap piece 150 thus forming a fourth strap section 160D. The slide buckle 120 is positioned at a suitable distance from the fixed buckle 110 for the second keeper counterpart 130 to reach the first keeper counterpart 154 such that the fourth strap section 160D is remained relatively tightly against the third strap section 160C. As a result that there is no excess sag between the intermediate and outside layer of the strap 100. As one may appreciate, the end result is a strap with three layers and a secured free end. With the fourth strap section 160D covering the fixed buckle 110, the spring-loaded cam mechanism cannot be released accidentally, which improves safety of the strap especially in diving applications. Additionally, the fourth strap section 160D covers the keeper hook 122 thus preventing the keeper hook 122 from becoming stuck to an external object.

FIG. 4 shows the placement and details of the hardware 110, 120, 130, 140 of the strap as well as the three layers formed by the four sections 160A . . . 160D of the second strap piece 160.

Figure 5:
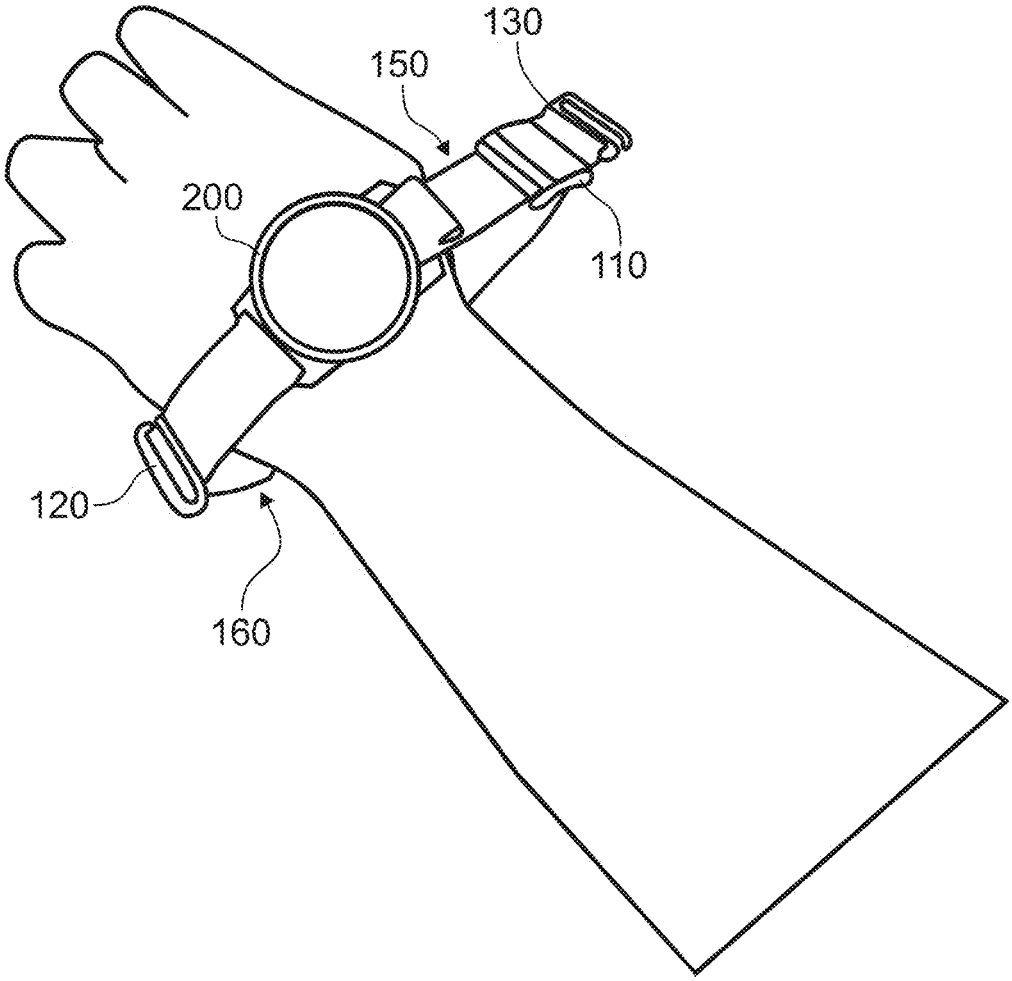
FIG. 5 illustrates a perspective view of the wearable device of FIG. 1 being put on a wearer.

Fitting and adjusting the strap 100 is illustrated in sequence in FIGS. 5 to 9. The fitting and adjusting procedure begins with placing the strap 100 in loosened and looped configuration around a host, such as an extremity of the user. FIG. 5 shows a person's wrist as a meaningful example of such a host. At this stage the strap 100 is loosened to its loosest state, in which the second keeper counterpart 130 at the free end of the second strap piece 160 is near the fixed buckle 110 at the free end of the first strap piece 150.

Figure 6:
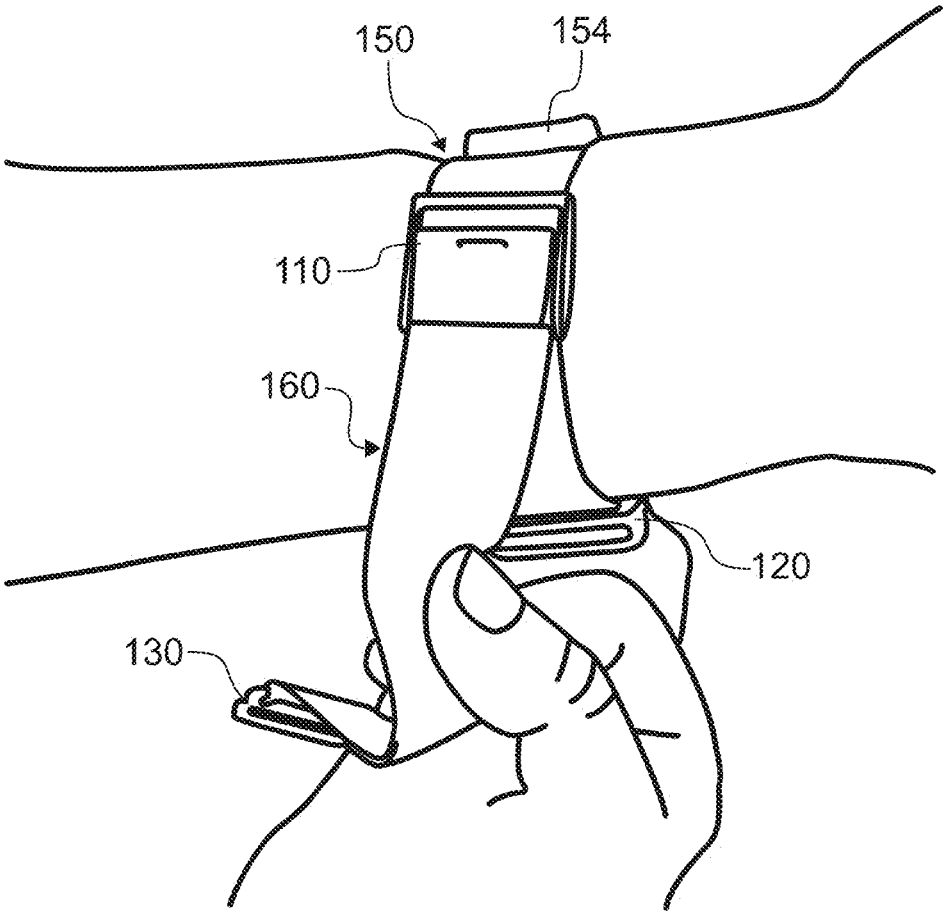
FIG. 6 illustrates a perspective view of tightening the strap of the wearable device of FIG. 1.
Figure 7:
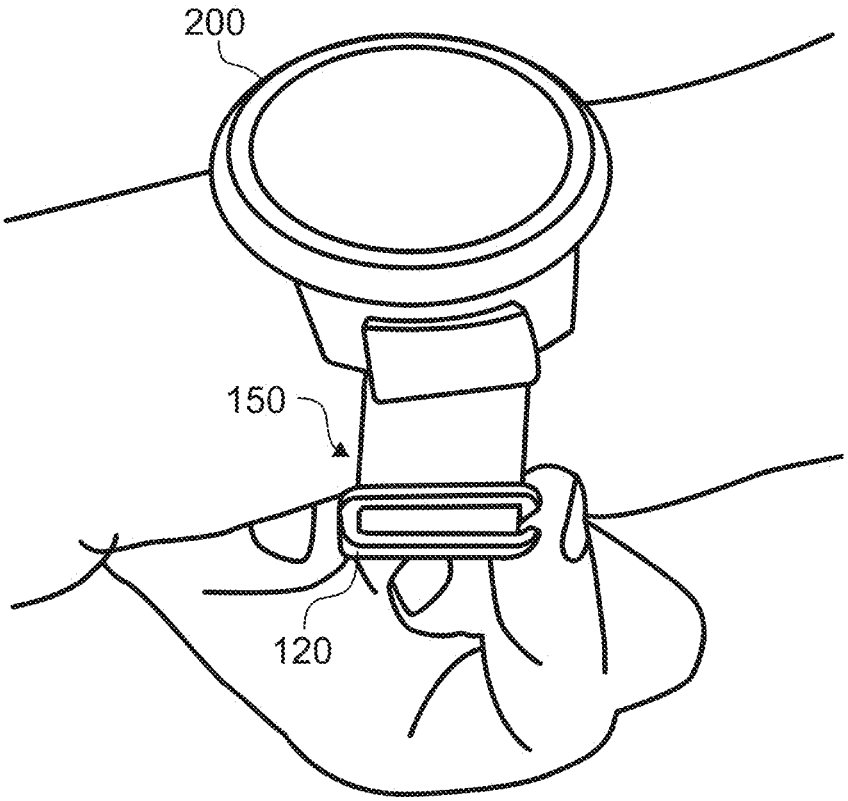
FIG. 7 illustrates a perspective view of adjusting the slide buckle of the strap of the wearable device of FIG. 1.

With the wearable device put on the user, the next step is to tighten the strap 100. As is depicted in FIG. 6, the strap 100 is tightened by pulling the free end of the strap away from the fixed buckle 110, until the strap 100 fits snugly on the user. At this stage there is a considerably amount of excess strap 100, which will be secured to the first keeper counterpart 154.

Figure 8:
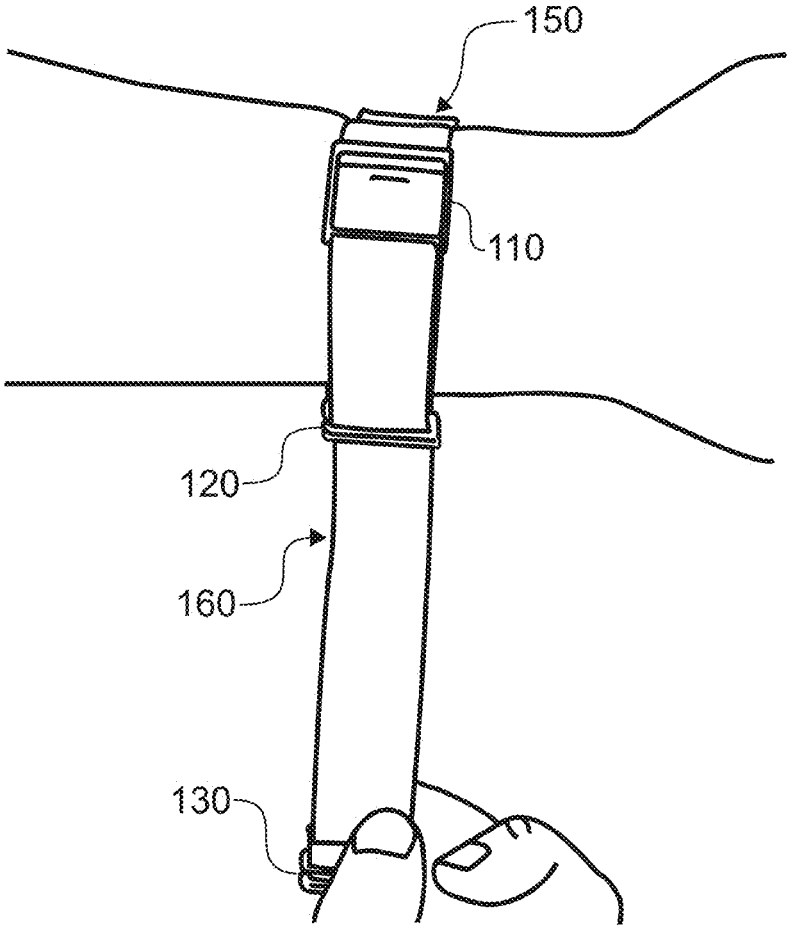
FIG. 8 illustrates a perspective view of fitting an excess portion of the strap of the wearable device of FIG. 1 through and folding it around the slide buckle.
Figure 9:
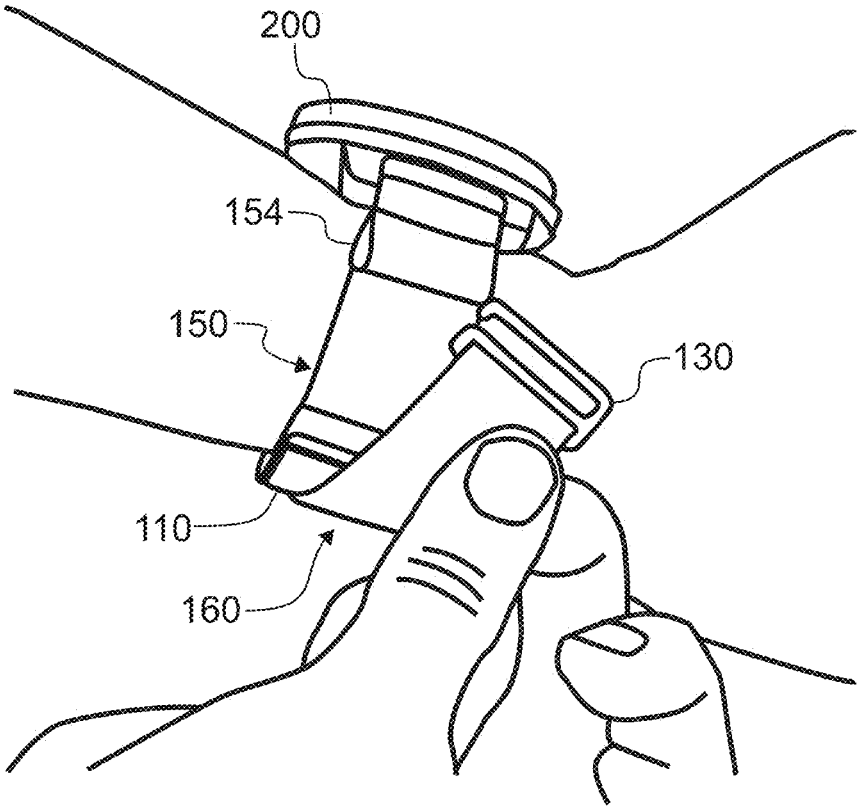
FIG. 9 illustrates a perspective view of fitting the second keeper counterpart of the strap of the wearable device of FIG. 1 to the respective first keeper counterpart.

If it is the first time using the strap 100 or the strap 100 must be resized, the slide buckle 120 may need adjusting for the second keeper counterpart 130 to reach the first keeper counterpart 154 with minimal slag on the outer layer of the strap. To do this, the slide buckle 120 is moved along the strap 100 to a suitable position (FIG. 7), after which the strap body is slipped underneath the keeper hook 122 of the slide buckle 120 (FIG. 8). With the strap body passing through the keeper hook 122, it is time to fold the excess portion of the strap body on top of the intermediate layer to form the outside layer and clip the second keeper counterpart 130 into the first keeper counterpart 154 (FIG. 9).

Figure 10:
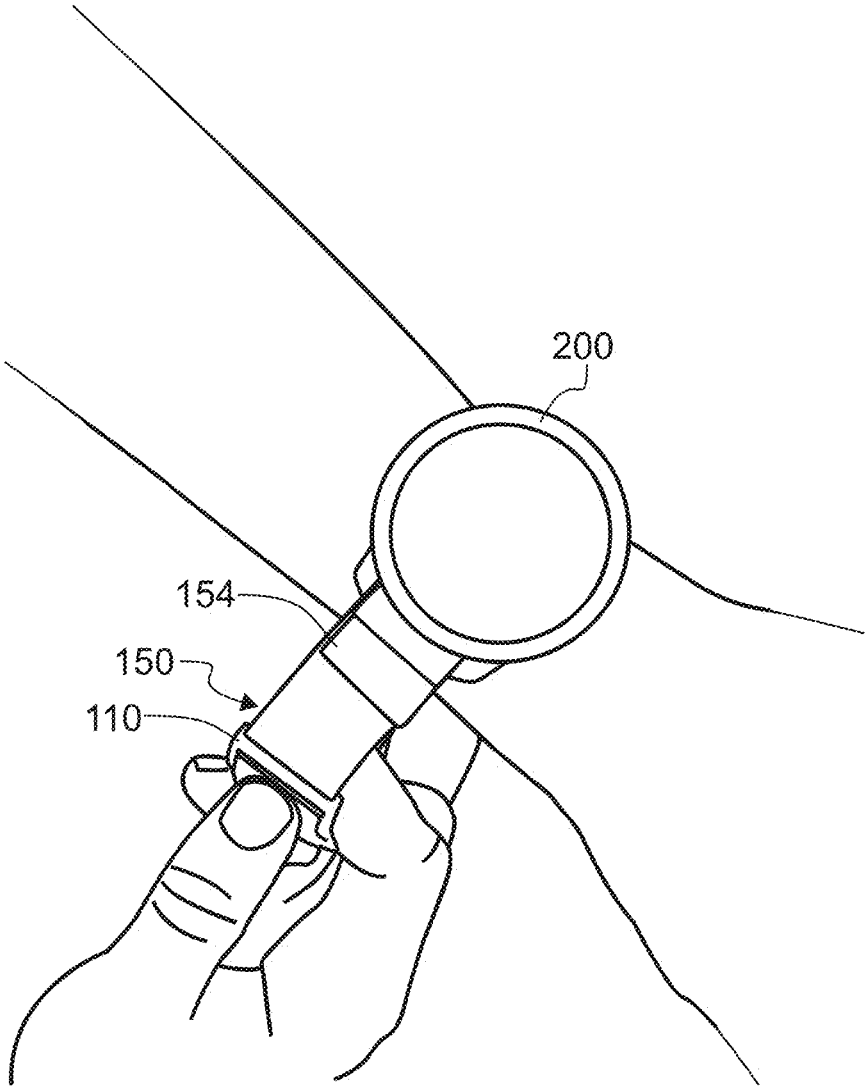
FIG. 10 illustrates a perspective view of loosening the strap of the wearable device of FIG. 1.

The strap 100 may be removed by first detaching the second keeper counterpart 130 from the first keeper counterpart 154 (FIG. 9), which exposes the fixed buckle 110 from underneath the outside layer of the second strap piece 160. The strap 100 may then be loosened by releasing the fixed buckle 110. In the embodiment of FIG. 10, the fixed buckle 110 is a cam buckle, which is released by pressing the cam against a biasing spring. With the fixed buckle 110 released, the strap 100 may be loosened by sliding the strap body through the fixed buckle 110. The slide buckle 120 may be left in its current position, which acts as a baseline setting for the strap 100. Accordingly, the strap 100 may be put on again by simply tightening the strap with aid of the fixed buckle 100 without adjusting the slide buckle, wherein the second keeper counterpart 130 is correctly set to reach the first keeper counterpart 154.

The embodiment herein described with reference to FIGS. 1 to 10 may be varied in a number of ways, which may be combined.

The illustrated embodiment involves the strap 100 on a smart watch intended for diving. The terminal device 200 may, however, be any worn apparatus. Alternative examples include traditional watches, sport watches, compasses, trackers, pilot and skydiving instruments, as well as other sensors, instruments, communication devices, and personal aid devices.

The illustrated exemplary strap 100 is intended to be worn on a wrist. The strap 100 may, however, be modified for attachment to any foreseeable host. Alternative examples include straps dimensioned to be attached to ankles, arms, and thighs of a person as well as on legs, necks, or other parts of other animals. A particular application of the strap 100 and an associated terminal device is a canine tracker collar.

The illustrated embodiment involves spring bars 140 as an example of an affixer for attaching the strap 100 to the case of the terminal device. The strap 100 could alternatively be looped around pins fixed to the case. Other affixer alternatives include rivet lug attachments as well as magnetic, slide, or shape locking counterparts on the first ends of the strap pieces and the case.

In the illustrated example the fixed buckle 110 is devised as a friction buckle, more specifically a cam buckle. Other alternatives include tang buckles, ratchet buckles, roller buckles, side release buckles, slide buckles, snap buckles, and tie buckles. Regardless of the buckle type selected, it is preferred to favour a buckle that cannot be accidentally undone.

In the illustrated example the first keeper counterpart 154 is devised as a female keeper counterpart and the second keeper counterpart 130 is devised as a corresponding male keeper counterpart. According to an alternative embodiment, however, the orientation may be reversed by devising the first keeper counterpart as a male keeper counterpart, such as a hook adjacent the terminal device, and the second keeper counterpart as a corresponding female keeper counterpart, such as a loop at the end of the strap body.

In the illustrated example the strap comprises only one female keeper counterpart, namely the first keeper counterpart 154. According to an alternative embodiment, however, the strap may include several female keeper counterparts provided along the strap. According to a particular alternative embodiment, the strap comprises a third keeper counterpart, particularly a female keeper counterpart, provided to the strap near the terminal device but on the other side of the first keeper counterpart. More specifically, the third keeper counterpart may be provided to the second strap piece, if the strap is constructed as a two-piece strap. In the latter example the third keeper counterpart may be provided to the first end of the second strap piece.

The illustrated embodiment shows the strap 100 as being formed with two strap pieces 150, 160. The benefit of a two-piece strap is to leave the back side of the terminal device uncovered for the purpose using sensors on the device, e.g. optic heart rate sensors. The strap could, however, be devised as a single-piece strap, such as a NATO strap. According to an alternative embodiment (not shown), the strap comprises a single strap body that extends under the terminal device and is secured thereto with a paratrooper or parachute mechanism, for example. In a paratrooper or parachute strap configuration the strap body is secured between lugs on the terminal device with spring bars. The strap body extends under the case back and over the spring bars, which press the strap body against the terminal device. A single-piece strap has the benefit of being more robust for use applications, such as diving and skydiving, which value robustness through redundancy over optical sensors. By clamping the strap body against the case of the terminal device with two spring bars or other affixers, failure of one affixer would not result in detachment of the device from the user. Such reliability is greatly valued in hostile environments, where data produced by the terminal device is important or even vital.

According to the single-piece embodiment the strap comprises a single strap body. A fixed buckle, such as that shown in connection with the two-piece strap of FIGS. 1 to 10, is provided to one end of the strap body. The fixed buckle is set to receive the strap body through the fixed buckle in a looped configuration of the strap. The strap also comprises a slide buckle, such as that shown in connection with the two-piece strap of FIGS. 1 to 10, provided movably to the strap body. The slide buckle comprises an open keeper hook for removably receiving an excess portion of the strap body through the keeper hook. A first keeper counterpart, such as that shown in connection with the two-piece strap of FIGS. 1 to 10, is provided on the strap body. A second keeper counterpart, such as that shown in connection with the two-piece strap of FIGS. 1 to 10, is provided to a second end, i.e. a free end, of the strap body for attachment to the first keeper counterpart.

The single-piece embodiment may be varied similarly to the two-piece embodiment has herein foreseen.

For the sake of completeness, herein it is disclosed a specific embodiment of a strap 100 for a wearable device 300 comprising a terminal device 200. The strap 100 comprises a first strap piece 150. The first strap piece 150 comprises a strap body 151, which extends between a first end 152 for attachment to the terminal device 200 and a second end 153. The first strap piece 150 also comprises a first keeper counterpart 154, such as a first keeper counterpart. The strap 100 also comprises a second strap piece 160. The second strap piece 160 comprises a strap body 161, which extends between a first end 162 for attachment to the terminal device 200 and a second end 163. The strap 100 also comprises a fixed buckle 110 provided at the second end 153 of the first strap piece 150 and configured to receive the strap body 161 of the second strap piece 160 through the fixed buckle 110. The strap 100 also comprises a slide buckle 120 provided movably to the second strap piece 160 and comprising an open keeper hook 122 for removably receiving an excess portion of the second strap piece 160 through the keeper hook 122. The strap 100 also comprises a second keeper counterpart 130, such as an end hook, provided to the second end 163 of the second strap piece 160 for repetitive removable attachment to the first keeper counterpart 154.

The above disclosed specific embodiment may be combined with any one of the details disclosed with reference to FIGS. 1 to 10.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

REFERENCE SIGNS LIST

| NO. | FEATURE |
|---|---|
| 100 | strap |
| 110 | fixed buckle, e.g. cam buckle |
| 120 | slide buckle |
| 121 | body |

-continued

REFERENCE SIGNS LIST

| NO. | FEATURE |
|---|---|
| 122 | keeper hook |
| 130 | second keeper counterpart, e.g. end hook |
| 140 | affixer, e.g. spring bar |
| 150 | first strap piece, e.g. short piece |
| 151 | body |
| 152 | first end |
| 153 | second end |
| 154 | first keeper counterpart, e.g. keeper loop |
| 160 | second strap piece, e.g. long piece |
| 161 | body |
| 162 | first end |
| 163 | second end |
| 200 | terminal device, e.g. watch body |
| 300 | wearable device, e.g. watch |

The invention claimed is:

1. A strap for a wearable device comprising a terminal device, the strap comprising:

a strap body, a fixed buckle provided to one end of the strap body and configured to receive the strap body through the fixed buckle in a looped configuration of the strap, a slide buckle provided movably to the strap body and comprising an open keeper hook for removably receiving an excess portion of the strap body through the open keeper hook, a first keeper counterpart, which is a keeper loop provided on the strap body by sewing from material of the strap body, and a second keeper counterpart provided to a second end of the strap body for attachment to the first keeper counterpart.

2. The strap according to claim 1, wherein the strap body is made of a pliable material.

3. The strap according to claim 1, wherein the first keeper counterpart is fixed to the strap body.

4. The strap according to claim 1, wherein the first keeper counterpart is provided to the external side of the strap facing away from a user.

5. The strap according to claim 1, wherein the first keeper counterpart is configured to receive the second keeper counterpart transversally in respect to a main extending dimension of the strap.

6. The strap according to claim 1, wherein the fixed buckle is a friction buckle.

7. The strap according to claim 1, wherein the fixed buckle is configured to selectively lock the strap body extending through the fixed buckle.

8. The strap according to claim 1, wherein the slide buckle comprises a body that is configured to receive the strap body through an opening in the body of the slide buckle, wherein the slide buckle is configured to slide along the strap body.

9. The strap according to claim 1, wherein said open keeper hook is configured to removably receive and hold an excess portion of the strap body.

10. The strap according to claim 1, wherein the keeper hook is provided to an external side of the strap.

11. The strap according to claim 1, wherein:

the strap comprises a first strap piece and a second strap piece, wherein the strap body is comprised of the first strap piece and the second strap piece, a strap body of the first strap piece extends between a first end, which is for attachment to the terminal device, and a second end, to which the fixed buckle is provided, and wherein a strap body of the second strap piece extends between a first end, which is for attachment to the terminal device, and a second end, to which the second keeper counterpart is provided.

12. The strap according to claim 11, wherein respective first ends of the first and second strap pieces comprise affixers for fixing the strap to the wearable device.

13. The strap according to claim 11, wherein the slide buckle is provided movably to the second strap piece.

14. The strap according to claim 13, wherein the first keeper counterpart is fixed to the first strap piece.

15. The strap according to claim 1, wherein the fixed buckle is a cam buckle.

16. A wearable device comprising a terminal device and a strap, which comprises:

a strap body, a fixed buckle provided to one end of the strap body and configured to receive the strap body through the fixed buckle in a looped configuration of the strap, a slide buckle provided movably to the strap body and comprising an open keeper hook for removably receiving an excess portion of the strap body through the open keeper hook, a first keeper counterpart, which is a keeper loop provided on the strap body by sewing from material of the strap body, and a second keeper counterpart provided to a second end of the strap body for attachment to the first keeper counterpart.

* * * * *